US011549298B2

(12) United States Patent
Girotto et al.

(10) Patent No.: US 11,549,298 B2
(45) Date of Patent: Jan. 10, 2023

(54) SERVOMECHANISM FOR FURNITURE LEAF

(71) Applicant: BORTOLUZZI SISTEMI S.P.A.

(72) Inventors: Adriano Girotto, Belluno (IT); Rodolfo Dal Castel, Belluno (IT); Daniele Sbardella, Belluno (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 371 days.

(21) Appl. No.: 16/767,168

(22) PCT Filed: Nov. 24, 2018

(86) PCT No.: PCT/IB2018/059270

§ 371 (c)(1),
(2) Date: May 27, 2020

(87) PCT Pub. No.: WO2019/106508

PCT Pub. Date: Jun. 6, 2019

(65) Prior Publication Data

US 2020/0386028 A1 Dec. 10, 2020

(30) Foreign Application Priority Data

Nov. 28, 2017 (IT) ..... 102017000136830

(51) Int. Cl.
*E05F 5/00* (2017.01)

(52) U.S. Cl.
CPC ..... *E05F 5/003* (2013.01); *E05Y 2201/246* (2013.01); *E05Y 2201/46* (2013.01); *E05Y 2201/624* (2013.01); *E05Y 2201/638* (2013.01); *E05Y 2201/684* (2013.01); *E05Y 2201/708* (2013.01); *E05Y 2800/674* (2013.01); *E05Y 2900/20* (2013.01)

(58) Field of Classification Search
CPC ..... E05F 5/003; E05Y 2201/246; E05Y 2201/46; E05Y 2201/638
See application file for complete search history.

(56) References Cited

U.S. PATENT DOCUMENTS

| | | | | |
|---|---|---|---|---|
| 4,821,375 | A * | 4/1989 | Kozon | E06B 3/5045 312/331 |
| 5,149,180 | A * | 9/1992 | Haab | E06B 3/5045 312/331 |
| 9,057,216 | B2 * | 6/2015 | Bortoluzzi | E05F 5/00 |
| 10,227,806 | B2 * | 3/2019 | Gabi | E05F 1/16 |
| 11,008,791 | B2 * | 5/2021 | Rupp | E05F 1/08 |
| 11,136,804 | B2 * | 10/2021 | Rupp | E05F 5/003 |

(Continued)

FOREIGN PATENT DOCUMENTS

| | | | | |
|---|---|---|---|---|
| AT | 520731 | B1 * | 7/2019 | E05D 15/06 |
| DE | 102009027323 | A1 * | 1/2011 | E05F 5/003 |

(Continued)

OTHER PUBLICATIONS

Translation of De102009027323A1 from Espacenet (Year: 2022).*

*Primary Examiner* — Daniel J Rohrhoff
(74) *Attorney, Agent, or Firm* — Mark M. Friedman

(57) ABSTRACT

A servomechanism for sliding doors of furniture item is described. An eddy-currents magnetic damper (80) to dampen the door is used to brake two carriages (26) mounted slidingly on the linear guides (20) for slidingly supporting the door.

8 Claims, 3 Drawing Sheets

(56) References Cited

U.S. PATENT DOCUMENTS

| | | | | |
|---|---|---|---|---|
| 2008/0218043 | A1* | 9/2008 | Gianelo | A47B 43/00 312/319.2 |
| 2010/0270898 | A1* | 10/2010 | Haab | E06B 3/5045 312/323 |
| 2022/0056746 | A1* | 2/2022 | Meusburger | E05D 15/58 |

FOREIGN PATENT DOCUMENTS

| | | | |
|---|---|---|---|
| DE | 102009027323 | A1 | 1/2011 |
| EP | 3029248 | A1 | 6/2016 |
| WO | WO-2017141236 | A1 * | 8/2017 |

* cited by examiner

N
S
P
68
70
72
76
80
82
86
88
92

SERVOMECHANISM FOR FURNITURE LEAF

The invention refers to a servomechanism for a sliding furniture leaf.

Sliding doors of furniture in general are supported by carriages having wheels rolling over linear tracks, to make the doors movable with little friction. A system is shown in U.S. Pat. No. 9,057,216. Here the mechanism envisages two linear guides on which respectively slide two carriages joined by a vertical bar to support and move the door. The carriages are moved by an articulated parallelogram, of which the vertical bar forms one side and the two sides of the parallelogram are joined by two equal arms. The arms are integral to a cam that is set into rotation thanks to the pressure of a slider pushed by springs. Depending on the size of the door, that is on the mass to be moved, one must size the number and/or size of the springs, unfortunately restricting standardization.

To brake and to make the door reach the end of the stroke during the closing movement there is provided a fluid-dynamic piston or shock absorber, which however does not produce a smooth (and silent) braking and tends to be damaged because it absorbs all the kinetic energy of the door in a very short time.

Improving this state of the art is the main object of the invention, which is defined in the attached claims, in which the dependent ones define advantageous variants.

Another object is to obtain a servomechanism, to move a furniture door, which is durable.

Another object is to obtain a servomechanism, to move a furniture door, which brakes the door in a progressive way and without recoils.

The servomechanism to move a door of a piece of furniture comprises:

two parallel and horizontal linear guides, two carriages respectively slidingly mounted, e.g. through wheels, on the linear guides to slidingly support the door, an articulated parallelogram formed by a vertical bar that is connected to the two carriages and mounted for supporting and moving the door, and two equal arms pivoted to a side panel of the piece of furniture, a cam integral with an arm, a movable slider biased towards the cam by an elastic element in such a way as to push on the cam and rotate the arm, an eddy-current magnetic damper to dampen the door.

The magnetic damper exploits the parasitic currents induced by a variable magnetic field inside an electrically conductive material. The induced eddy currents in turn generate a magnetic field of opposite polarity to the inducing one, so that the two fields attract each other and develop the braking action.

The eddy current magnetic damper has many advantages:

- it produces a braking force that acts throughout the stroke of the door, thereby increasing dynamic control on the door,
- it produces a braking similar to viscous friction, i.e. a braking force proportional to the speed of the door. This allows a smoother and moro homogeneous braking;
- compared to US9057216, it allows the same spring to be used for various sizes of the door, because it compensates a spring too big for a small door and vice versa;
- it eliminates the noise generated by the hooking and release of the fluid-dynamic shock absorber, that is, it is silent.

Said two arms may be pivoted on a vertical bar in turn hinged on a side panel of the piece of furniture. A vertical bar may be connected to the cam to close the parallelogram, with greater structural stability.

In the following, a magnetic north or south pole is indicated by the letters N or S.

In a preferred embodiment, the magnetic damper comprises a linear guide in which a slid integral with the door is slidingly mounted. The linear guide and/or the skid comprises permanent magnets and, respectively, the skid and/or the linear guide comprises a metal track which a magnetic field generated by the permanent magnets can hit and slide upon.

The metal track may be constituted e.g. of aluminum, copper, high carbon-content steel.

In a more preferred embodiment, said linear guide of the magnetic damper is integrated into one of said two linear parallel guides, for less bulk. In particular, said linear guide of the magnetic shock damper and said one of said two parallel linear guides are constituted of a single section bar, e.g. made out of aluminum, copper, or high carbon-content steel.

Said single section bar preferably comprises a channel for a wheel of one of said carriages.

Preferably said single section bar or said track comprises or is constituted by two coplanar cantilevered fins, on two opposite flat sides of which a sliding skid comprising permanent magnets is mounted.

In a preferred embodiment of the skid, it comprises two flat and parallel elements, spaced apart from each other, mounted in such a way that they can slide while keeping the coplanar fins therebetween, on each flat element being provided permanent magnets.

In an even more preferred embodiment of the skid, the two flat and parallel elements each comprise a low carbon-content steel plate on which the permanent magnets are arranged.

Preferably the permanent magnets have a polar axis orthogonal to the surface of the track or of a fin.

Preferably each flat element comprises a row of permanent magnets aligned along the length of the track or of a or each fin. These two rows, which are parallel and belonging to a different flat element, are specularly arranged (i.e. one facing the other) with respect to the track or fin. That is to say that for one or each fin there are two parallel rows of permanent magnets that are mounted on opposite sides of the track or fin.

In particular, each flat element may comprise two or more parallel rows of magnets, arranged so that on each opposite side of a track or fin there is a row of magnets.

Preferably all the permanent magnets of one or each row have the N-S polar axes parallel to each other. Even more preferably, the N-S/S-N polar axis of each permanent magnet, belonging to a row arranged along one side of the track or fin, is coincident with the N-S/S-N polar axis of a permanent magnet of a row arranged on the opposite side of the track or fin.

Preferably the permanent magnets of one or each row are oriented in order to have N-S polar axis with alternate orientation, that is, taken a reference direction, if one magnet in the row has poles arranged with N-S order, the next in the row will have them ordered S-N, and so on.

It is understood that instead of the aforementioned permanent magnets one may use also other types of magnetic flux generators, such as e.g. electrically-powered solenoids.

The advantages of the invention will be even clearer from the following description of a preferred example of servomechanism, reference making to the attached drawing in which FIG. 1 shows a three-dimensional view of the servomechanism mounted on a piece of furniture;

In the figures, equal numbers indicate equal or conceptually similar parts, and elements are described as being used. To not crowd the figures, some numerical references are omitted.

Figure 2:
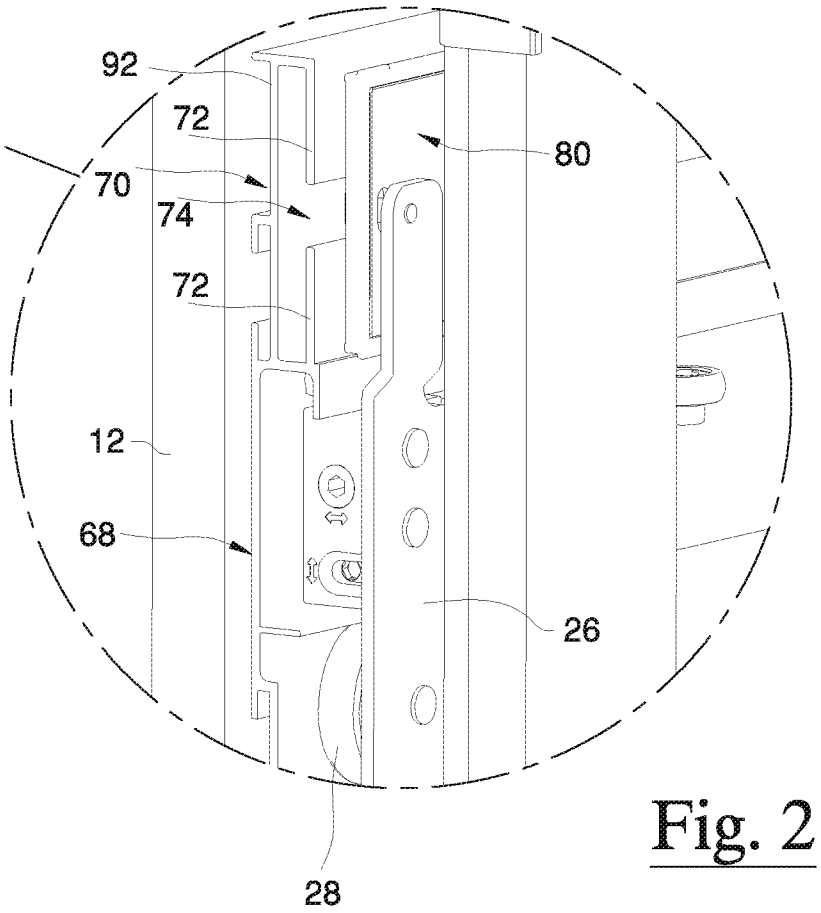
FIG. 2 shows an enlargement of FIG. 1.
Figure 1:
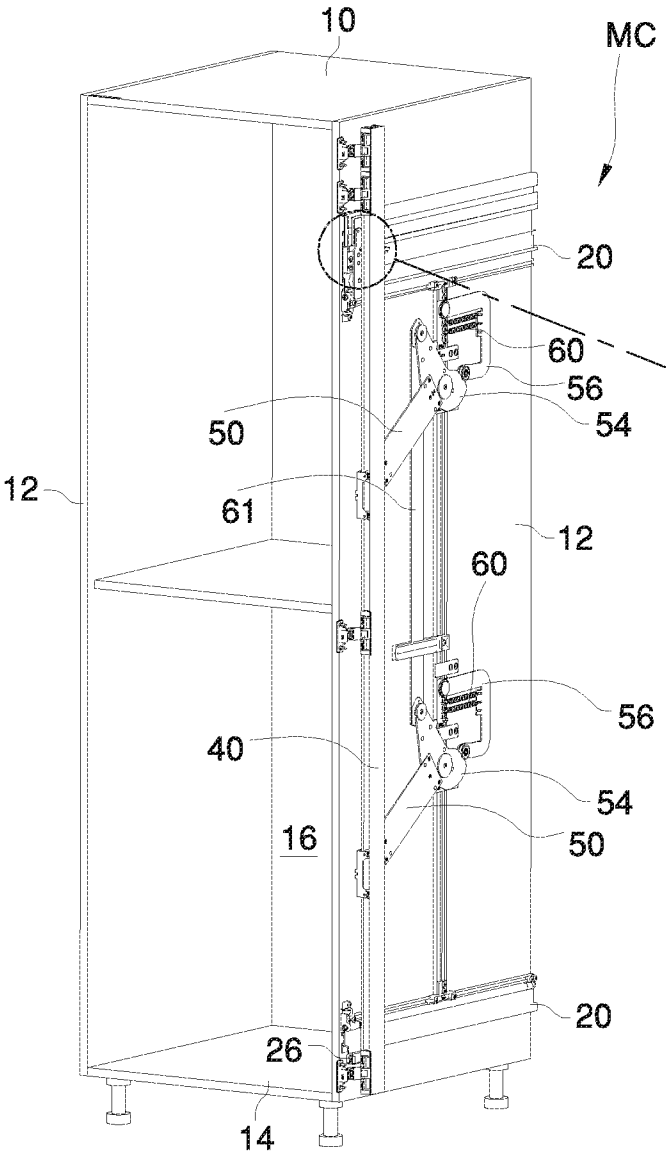
Figure 4:
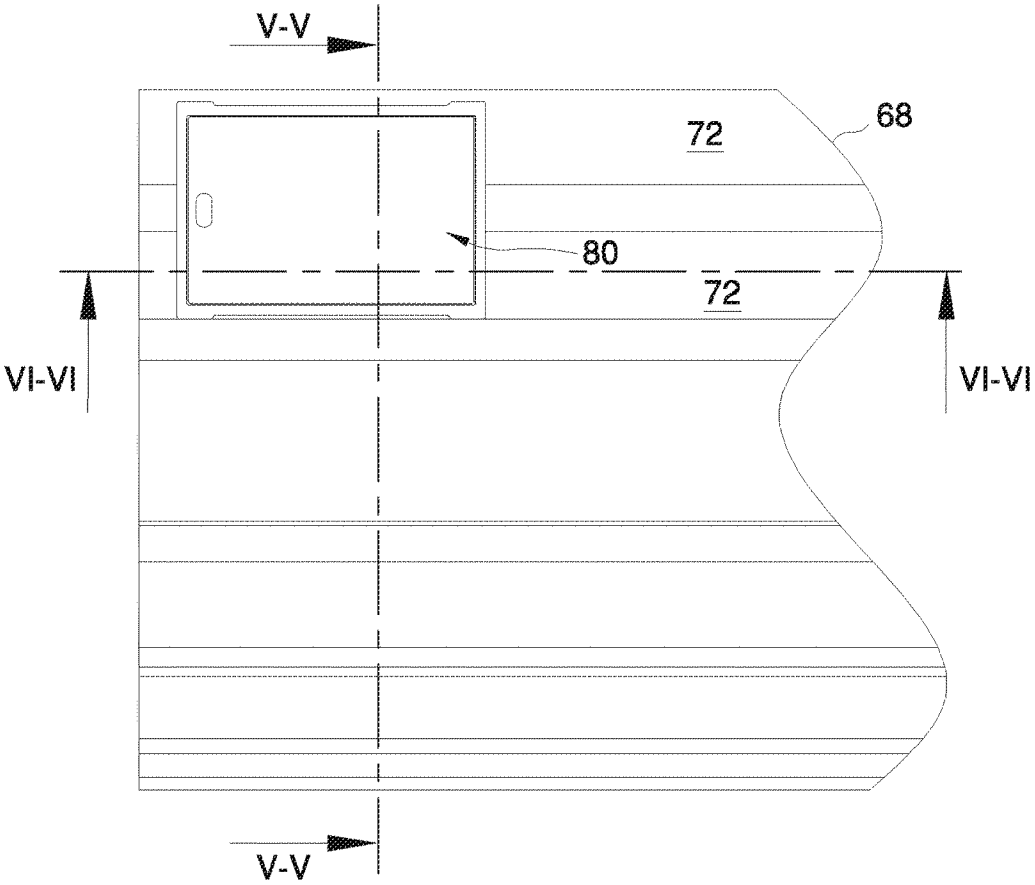
FIG. 4 shows a simplified side view of a section bar.
Figure 3:
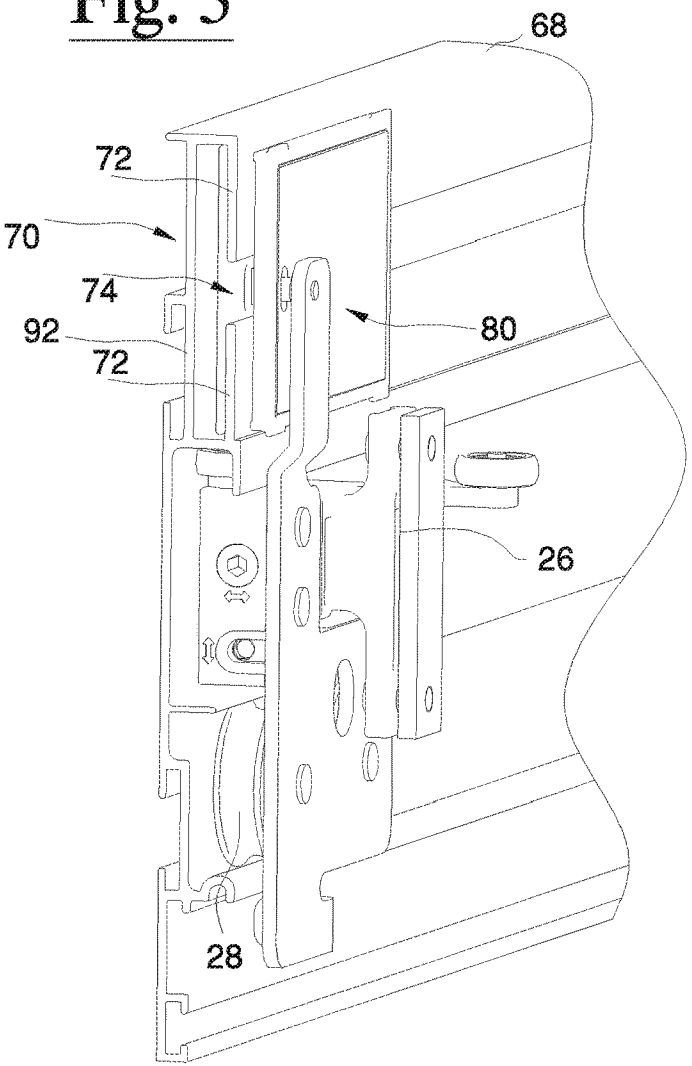
FIG. 3 shows isolated components of FIG. 2.

A piece of furniture MC comprises a compartment, formed by a ceiling 10, a bottom 14, a back 16 and side walls 12, in front of which a door (not shown) is slidingly mounted to close the compartment. The furniture MC may have even more compartments.

The furniture MC is equipped with a servomechanism to move the door between a closing position and an opening position. In the closed position the door's plane is parallel and superimposed on a side wall 12, while in the open position, the door closes the compartment, the door's plane becoming parallel to the back 16. Thus, the door while moving rotates by 90 degrees about a vertical axis.

The servomechanism comprises two parallel and horizontal linear guides 20 mounted at a certain distance from each other on a side wall 12.

Two carriages 26 are slidingly mounted by means of wheels 28 on the linear guides 20 to slidingly support the door back and forth along the wall side 12.

To apply a return force during the closing movement of the door or to apply an extraction force during the opening movement of the door, the furniture MC comprises an articulated parallelogram mounted on the side wall 12 between the two guides 20. The articulated parallelogram is formed by a vertical bar 40, connected to the two carriages 26 and on which the door is mounted, and two equal arms 50 pivoted to the wall 12.

On each arm 50 there is a cam 54, on which can slide a movable slider 56 pushed towards the cam 54 by a spring 60. Thus the slider 56 presses on the cam 54 and rotates the arm 50 in order to push the door toward the closing position or the opening position.

For greater stability it is preferable to "close" the articulated parallelogram with a vertical bar 61 pivoted between the cams 54.

The furniture MC comprises an eddy-current dampening magnetic shock absorber or system to dampen the door while it moves up to the end-of-travel point of the closing position.

The upper linear guide 20 is a metal section bar 68, e.g. made of aluminum or copper, whose cross-section is shaped to form rectilinear channels to accommodate a carriage 26 and a skid 80 of the shock absorber or cushioning system.

The carriage 26 and the skid 80 do not necessarily have to be separated elements; they could be a single element.

The section bar 68 has a portion 70, e.g. made of aluminum or copper, with C-shaped cross-section, i.e. a section comprising two cantilevered fins 72 which are flat, coplanar and parallel. The cantilevered fins 72 are separated from each other by a certain distance 74 and are offset with respect to a flat wall 92 of the section bar 68 (the central part of the C).

The skid 80 (FIGS. 5 and 6) is formed by two parallel and slightly spaced planes 82, which are mounted to slide while keeping the fins 72 therebetween (thanks to a sandwich structure).

The planes 82 have a specular structure and are formed by a flat metallic plate 86, e.g. made of low carbon-content steel, on which there are arranged rows of permanent magnets 88. In the example shown, there are two parallel rows of permanent magnets 88 for each plane 82, and each row of permanent magnets 88 in a plane 82 cooperates with a homologous row of permanent magnets 88 in the other plane 82 to induce a magnetic field on the fin 72 they are facing.

The permanent magnets 88 in each plane 82 have a polar axis P orthogonal to the plate 86 and to each fin 72.

Taken any reference orientation on a straight line orthogonal to the flat surface of the fins 72, in each row of permanent magnets 88 there are magnets with N-S polarity alternating with magnets with S-N polarity. That is to say that, in a row, if a magnet has N-S polarity the next magnet has S-N polarity, and vice versa.

Each magnet 88 of a row faces, on the other side of the fin 72 along the aforesaid line, a magnet 88 with an equally-oriented polar axis. That means that, in a row, the magnetic pole closest to the fin 72 of each magnet 88 is different from the pole of a counterpart magnet located on the other side of the fin 80. In short, considered two 88 magnets arranged along the same line orthogonal to a flap 72, their magnetic poles closest to the flap 72 are opposite (see example of N/S poles in FIGS. 7 and 8).

Figures 5, 6, 7, 8:
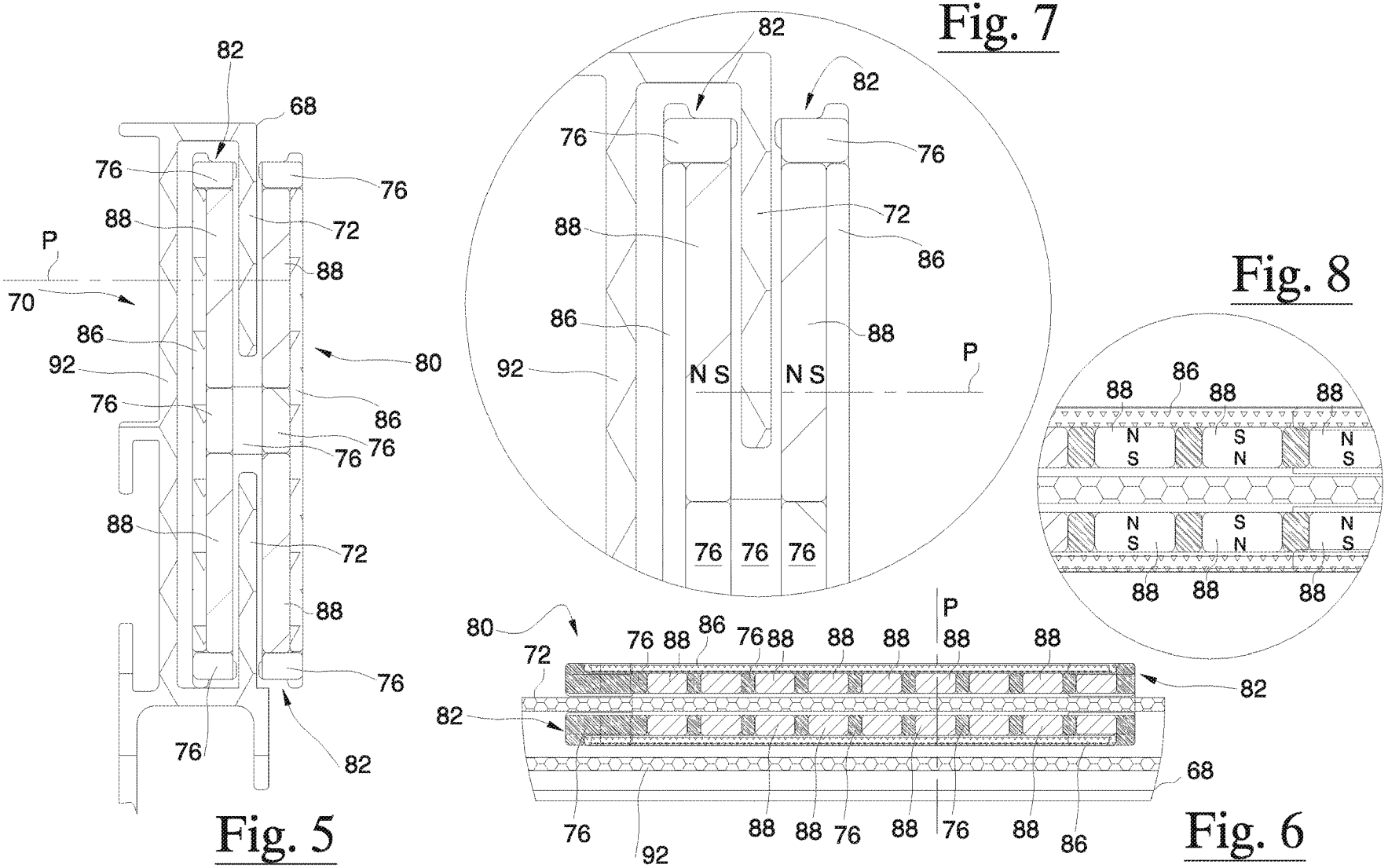
FIG. 5 shows a cross-sectional view according to the V-V plane.
FIG. 6 shows a cross-sectional view according to the VI-VI plane.
FIG. 7 shows an enlargement of FIG. 5.
FIG. 8 shows an enlargement of FIG. 6.

This way, the magnets 88 of a row cooperate with the homologues magnets 88 of the opposite row to create many successive crossings of magnetic flux inside a fin 72 (see FIG. 8).

Placing magnets 88 on two opposite sides of a fin 72 reinforces the magnetic flux that passes through the fin 72, thereby increasing the resulting braking effect deriving from eddy currents. With less braking efficiency, one may also use a single row of magnets 88 for interacting with a fin 72.

In the example shown, for each fin 72 there are two rows of cooperating magnets 88, therefore altogether the skid 80 comprises four rows of magnets 88, two by two coplanar. The rows of magnets may be in different number than what is illustrated.

The permanent magnets 88 are preferably enclosed and separated by elements 76, made preferably but not necessarily out of plastic material, also used at the center of the skid 80 to space the planes 82.

Operation

When the door moves in opposite directions along the wall 12 on the guides 20, the skid 80 slides correspondingly back and forth on the section bar 68. The sliding entails that the planes 82, with the magnets 88 carried by them, move relative to the fins 72. Since the magnets 88 are oriented in order to concentrate the magnetic field towards the fin 72, the fin 72 is hit by a considerable magnetic flux that changes over time. Consequently in the fin 72 eddy currents are induced which create a magnetic field of opposite polarity to the inducing one. The two fields attract each other and the skid 80 is braked by and from the fin 72.

The invention claimed is:

1. Servomechanism for moving a door of a furniture item (MC) comprising:

two parallel, horizontal linear guides (20), two carriages (26) respectively slidingly mounted, via wheels, on the linear guides (20) for slidingly supporting a leaf, an articulated parallelogram formed by a vertical bar (40) which is connected to the two carriages and is mounted for supporting and moving the door, and two equal arms (50) pivoted to a side panel of the furniture item, a cam (54) integral with an arm, a movable slider (56) which is biased toward the cam by an elastic element so as to push on the cam and rotate the arm, an eddy-currents magnetic damer (80) to dampen the door;

wherein the magnetic damper comprises a linear guide in which a skid (80) integral with the leaf is slidingly mounted, the linear guide and/or the skid comprising permanent magnets (88) and, respectively, the skid and/or the linear guide comprising a metal track (70) which a magnetic field generated by the permanent magnets can hit and slide on;

wherein the linear guide of the magnetic damper and said one of said two parallel linear guides are constituted of a single section bar (68), and wherein said single section bar or said track comprises or consists of two cantilevered coplanar fins, on whose opposed flat sides a skid comprised in the damper is slidingly mounted and comprises permanent magnets.

2. Servomechanism according to claim 1, wherein the magnetic damper comprises a linear guide in which a skid (80) integral with the leaf is slidingly mounted, the linear guide and/or the skid comprising permanent magnets (88) and, respectively, the skid and/or the linear guide comprising a metal track (70) which a magnetic field generated by the permanent magnets can hit and slide on.

3. Servomechanism according to claim 2, wherein the linear guide of the magnetic damer is integrated in one of said two parallel linear guides.

4. Servomechanism according to claim 1, wherein the metal track is made up of a material selected from aluminum, copper or high-carbon steel.

5. Servomechanism according to claim 1, wherein said single section bar (68) comprises a channel for a wheel comprised in one of said carriages.

6. Servomechanism according to claim 1, wherein the skid comprises two flat, parallel elements (82), spaced apart, mounted so that they can slide while keeping the coplanar fins therebetween, on each flat element being present permanent magnets (88).

7. Servomechanism according to claim 6, wherein the two flat parallel elements each comprise a low-carbon steel plate on which permanent magnets an arranged.

8. Servomechanism according to claim 6, wherein each flat element comprises a row of permanent magnets aligned along the direction of the length of the track or of one or of each fin, the two rows being parallel and arranged respectively on an opposite side of the track or opposite to the fin, wherein all the permanent magnets of a or each row have N-S polar axes parallel to each other and the N-S polar axis of each permanent magnet, belonging to a row placed along a side of the track or of the fin, coincides with the N-S polar axis of a permanent magnet of a row placed on the opposite side of the track or fin, and the permanent magnets of one or of each row are oriented so as to have N-S polar axis with alternate direction.

* * * * *